United States Patent [19]

Cooper et al.

[11] Patent Number: 5,067,840

[45] Date of Patent: Nov. 26, 1991

[54] BINDER LOCKING RING MECHANISM WITH CONFIGURED TRIGGER

[75] Inventors: Edward W. Cooper, Scarborough; Orlando R. Guerrieri, Pickering, both of Canada

[73] Assignee: Acco World Corporation, Wheeling, Ill.

[21] Appl. No.: 609,287

[22] Filed: Nov. 5, 1990

Related U.S. Application Data

[63] Continuation of Ser. No. 348,843, May 8, 1989, abandoned.

[51] Int. Cl.[5] ..... B42F 13/26

[52] U.S. Cl. ..... 402/38; 402/41

[58] Field of Search ..... 402/38, 41, 80 R

[56] References Cited

U.S. PATENT DOCUMENTS

| | | | |
|---|---|---|---|
| 1,897,001 | 2/1933 | Dawson | 402/38 |
| 1,927,113 | 9/1933 | Dawson | 402/38 |
| 2,061,676 | 11/1936 | Schade | 402/38 |
| 2,218,105 | 10/1940 | Griffin | 402/38 |
| 3,098,490 | 7/1963 | Wance | 402/38 |
| 3,101,719 | 8/1963 | Vernon | 402/38 |
| 3,884,586 | 5/1975 | Michaelis et al. | 402/38 |
| 4,813,803 | 3/1989 | Gross | 402/38 |

FOREIGN PATENT DOCUMENTS

| | | | |
|---|---|---|---|
| 2362356 | 6/1974 | Fed. Rep. of Germany | 402/38 |

*Primary Examiner*—Paul A. Bell

*Attorney, Agent, or Firm*—Pennie & Edmonds

[57] ABSTRACT

A loose-leaf binder having a casing and prong-carrying spring plates and having a mechanism for readily locking and unlocking the prongs through use of a trigger including pivot projections for pivoting on and in plate apertures. Locking is accomplished by lever lugs engaging casing blisters.

1 Claim, 2 Drawing Sheets

BINDER LOCKING RING MECHANISM WITH CONFIGURED TRIGGER

This is a continuation of application Ser. No. 07/348,843 filed May 8, 1989 now abandoned.

BACKGROUND OF THE INVENTION

Numerous techniques for holding ring binders in the closed position have been shown in prior patents (U.S. Pat. Nos. 1,927,113; 2,061,676; 3,098,490; and 3,101,719).

More recently, locking mechanisms as shown in U.S. Pat. Nos. 3,884,586 and 4,813,803 have been used to prevent inadvertent opening of ring binders when subjected to forces such as bumping or dropping of the binder.

SUMMARY OF THE INVENTION

Broadly, the present invention comprises a trigger-operated locking ring mechanism including a selectively blistered arched housing, prong plates, prongs and a trigger with (1) depending projections to accomplish, during opening and closing, pivoting with respect to the plates; (2) outer wings to limit trigger travel; and (3) upper lugs angled and configured to provide locking with complementary blistered-formed recesses in the arched housing.

It is a feature that the trigger is pivotally controlled during later stages of its closing to provide secure locking of the mechanism and when closed is held between plate pivots and the blistered housing firmly enough to resist unintended opening.

DESCRIPTION OF THE PREFERRED EMBODIMENTS

Figure 2:
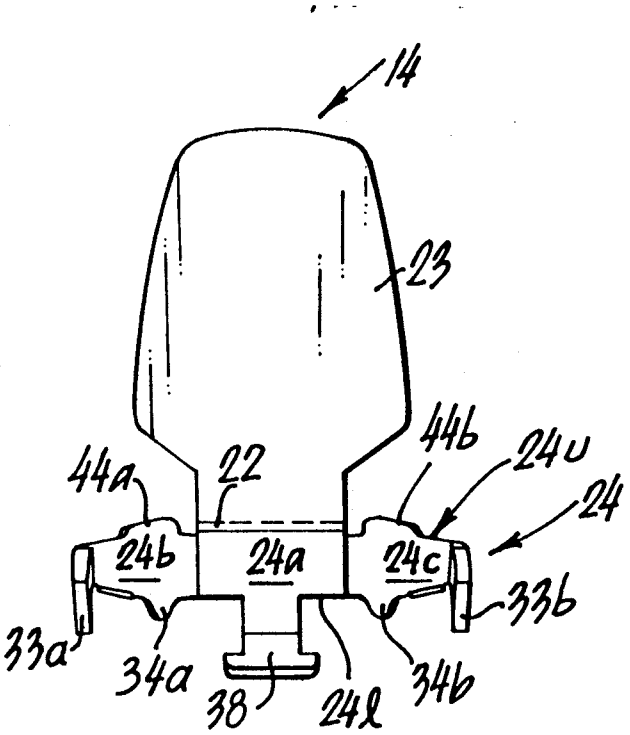
FIG. 2 is an end elevational view of the trigger alone as positioned in FIG. 2.

With reference to FIGS. 1–7, the loose-leaf binder mechanism 9 of the present invention includes an elongated arched case housing member 10, a pair of elongated spring hinge plates 11 and 12 each of which carries two or more rings 13 composed of mating ring halves 13*a*, 13*b*, and a swingable trigger lever 14. Case member 10 and hinge plates 11 and 12 are made of a relatively stiff spring-like metal or other suitable material. The binder mechanism 9 is secured to cover spine 16 of a loose-leaf cover 17 by means of rivets 18 extending through openings 18*a* in hinge plates 11, 12 to connect case 10 and book cover 17 together. Case 10 includes longitudinal edges 19 curled to form elongated hinge pockets 21 (FIG. 3) and bent-down case ends 10*a* and 10*b*.

Figure 4:
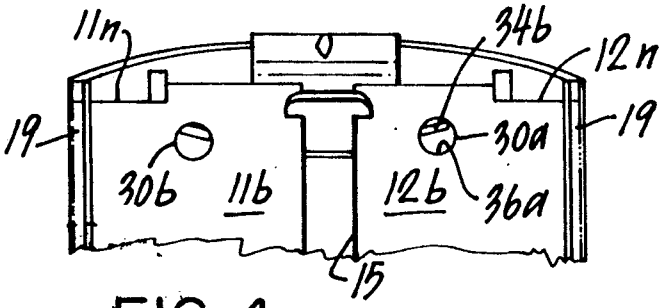
FIG. 4 is a partial bottom view of the mechanism in the closed position.

The inner longitudinal edges of hinge plates 11, 12 abut each other along their length (line A of FIG. 6) with their upper surfaces 11*a*, 12*a* facing toward each other in the ring prong closed position. In the ring-open position (FIG. 5) hinge plates 11, 12 have their upper surfaces 11*a*, 12*a* facing away from each other; each pair of aligned ring halves 13*a*, 13*b* being thereby spread apart to permit insertion or removal of loose-leaf sheets. Plates 11 and 12 have end notches 11*n*, 12*n* and the plates are configured to be spaced apart for a distance at their ends to create opening 15 (FIG. 4).

Figure 1:
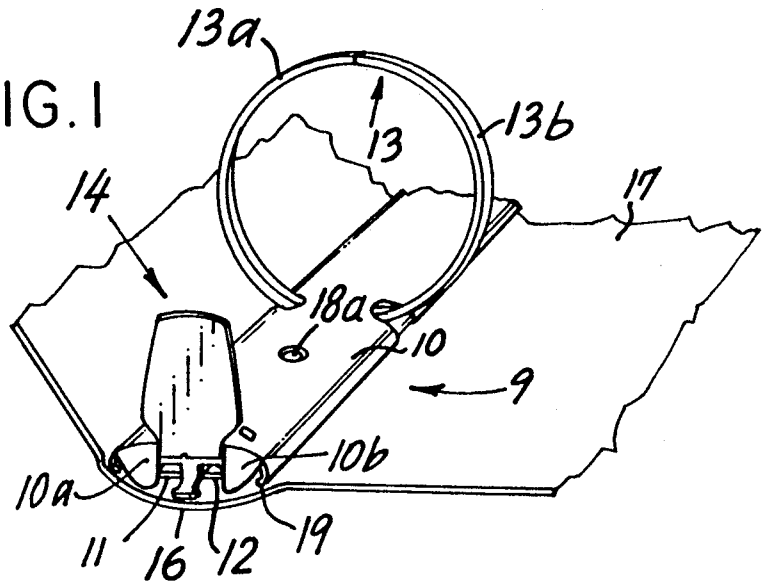
FIG. 1 is a perspective view of a portion of the ring binder including the locking ring mechanism of the present invention.
Figure 7:
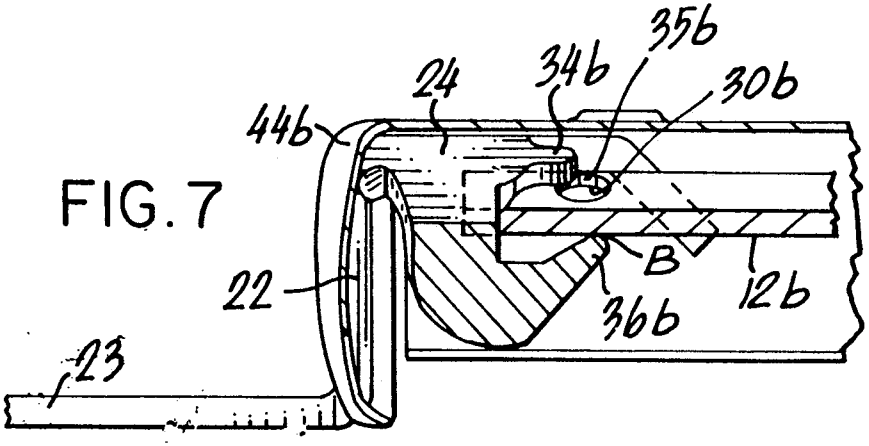
FIG. 7 is a sectional view along line 7–7 of FIG. 5.
Figure 5:
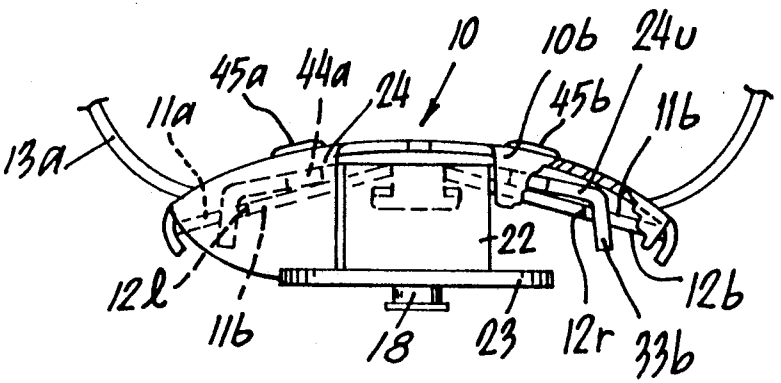
FIG. 5 is a cutaway elevational view of the mechanism in an open position.
Figure 6:
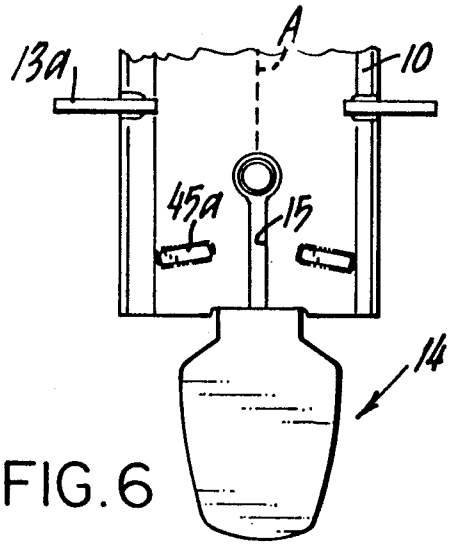
FIG. 6 is a partial plan view of the mechanism including the trigger in open position.

Turning to FIGS. 2 and 7, the trigger lever 14 includes horizontal body portion 22, an upper handle portion 23 and a lower transversely generally arcuate skirt member 24 in turn including center skirt portion 24*a* and wing portions 24*b* and 24*c*, all portions vertically oriented in the locked position (FIGS. 1 and 2). Skirt 24 has upper profile surface 24*u* which conforms generally to the arched curvature of case 10 (FIGS. 4 and 5) with the exception of lugs 44*a*, 44*b* as further explained. Skirt member 24 extends downwardly in generally parallel orientation with handle 23 though offset from handle 23 by body portion 22 (FIG. 7). Case-engaging surface 24*u* including lugs 44*a*, 44*b* frictionally engages the underside of case 10 during movement of the trigger lever 14 to and from its locked position. Proper clearance between lower portion 22, surface 24*c*, and case 10 together with flexibility of case 10 eliminates the possibility of preventing or restricting proper lever movement.

Referring in particular to FIG. 2, lower body edge profile 24*l* of trigger portion 24 includes outer wing elements 33*a*, 33*b* and inner lug pivot projections 34*a*, 34*b*. The outer wings 33*a*, 33*b* engage the undersides 11*b*, 12*b* of plates 11 and 12 when trigger 14 is fully open. Lug projections 34*a*, 34*b* ride during trigger movement above, near or around prong plate apertures 30*a*, 30*b* in plates 11 and 12, respectively (FIG. 4). The lower body edge profile 24*l* of body portion 22 also carries a centrally located T-shaped plate control element 38 which curls backward toward the vertical plane of trigger 14 when locked and plate control element 38 lies in a notched opening 15. A similar trigger, a plate opening and other parallel parts and features are preferably positioned at the opposite end of the mechanism for duplicative operation.

Turning to FIGS. 3–6, trigger 14, upper spaced-apart lugs 44*a*, 44*b* are shaped, angled and positioned to locate in recesses 40*a*, 40*b* created under casing blisters 45*a*, 45*b* when trigger 14 is moved to closed and locked position. The blisters and lugs lie at an angle to longitudinal line A in the range of 15° to 45° or more. Casing 10, carrying blisters 45*a*, 45*b*, flexes as required to permit lugs 44*a*, 44*b* to enter and, during opening, to be moved out of the blisters. Engagement of lugs 44*a*, 44*b* in recesses 40*a*, 40*b* formed by and below blisters 45*a*, 46*a*, as complimentarily configured, provides greater resistance to the binder opening when dropped or otherwise subjected to large forces. Recesses 40*a*, 40*b* are preferably sized to receive lugs 44*a*, 44*b* in a snug fit with the blister walls of the recesses engaging the lugs at various locations.

Finally, FIG. 7 shows trigger 14 fully opened with wings 33*a*, 33*b* including wing toes 35*a*, 35*b* touching at point B the bottoms 11*b*, 12*b* of plates 11, 12.

Figure 3:
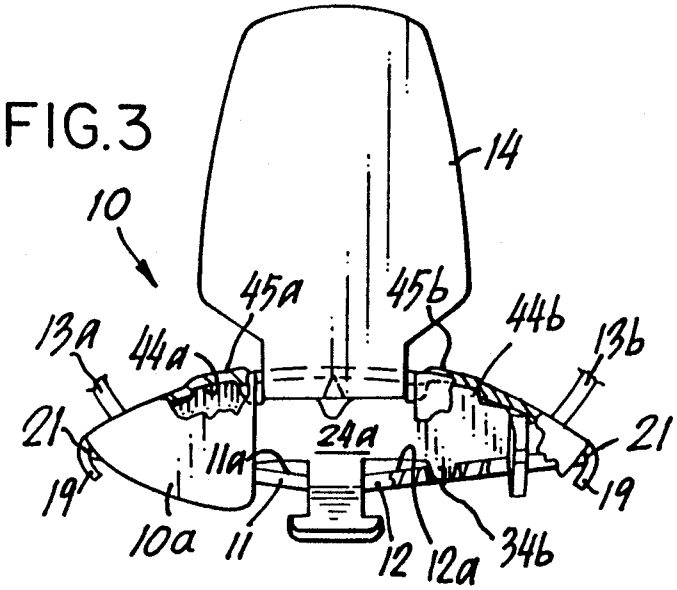
FIG. 3 is an end elevational view of the mechanism in a closed position.

In operation of the mechanism from fully opened to locked, trigger handle 23 of trigger 14 is grasped and is operated to move trigger 14 from its open position (FIG. 7) to its engaged locked position (FIG. 3). During this travel, lugs 34*a*, 34*b*, initially outside of apertures 30*a*, 30*b*, enter apertures 30*a*, 30*b* and engage the circumferential sides 36*a*, 36*b* of apertures 30*a*, 30*b*, respectively at various locations thereon to provide a pivot area in which lugs 34*a*, 34*b* operate to control the area about which lever 14 pivots during its travel from its open positions to and including its fully locked position. In the fully locked position, lugs 34*a*, 34*b* will preferably be oriented against those portions of surfaces 36*a*, 36*b*closest to lever 14 (FIG. 4). Trigger lever 14 is held in its locked or closed position by lugs 44*a*, 44*b* engaged in recesses 40*a*, 40*b* below blisters 44*a*, 44*b* and further by the close positioning of body portion 22 along the underside of case 10. To move trigger 14 to its unlock or open position sufficient force is required to be applied to trigger portion 23 to distort, bend and flex case 10, blisters 44*a*, 44*b*, plates 11, 12 and other parts of the mechanism to allow lug projections 44*a*, 44*b* to move into or out of blister recesses 40*a*, 40*b*.

The prongs 13 can be opened or closed directly by pulling or pushing on the prong halves 13*a*, 13*b* and the prongs can be opened or closed through movement of the trigger 14 which carries lever action through element 38 to lift or depress the plates.

We claim:

1. In a loose-leaf sheet binder lock mechanism having a case member, a pair of elongated hinge plates engageable along a centerline, ring halves mounted on the plates operable to form loose-leaf retaining rings, a trigger lever having a body portion vertically-oriented when the lever is closed and the trigger being operable to move the plates between an open ring position to a closed ring position, the improvement comprising a pair of spaced-apart blister means oriented at an angle to the plate centerline on said case member;

spaced-apart lugs on the body portion of the trigger lever oriented at an angle to the plate centerline for positioning in and engagement with such blister means;

trigger lower projections on the body portion; and apertures in the hinge plates for receiving and engaging the lower trigger projections whereby the trigger lever is pivotal about such apertures in moving the trigger lever to a locked position where said lugs are positioned in said blister means.

* * * * *